US010037668B1

(12) United States Patent
DesGarennes et al.

(10) Patent No.: US 10,037,668 B1
(45) Date of Patent: Jul. 31, 2018

(54) EMERGENCY ALERTING SYSTEM AND METHOD

(71) Applicant: Microsoft Technology Licensing, LLC, Redmond, WA (US)

(72) Inventors: Gabriel A DesGarennes, Issaquah, WA (US); Ryen W White, Woodinville, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/590,748

(22) Filed: May 9, 2017

(51) Int. Cl.
*G08B 23/00* (2006.01)
*G08B 21/04* (2006.01)
*G08B 21/02* (2006.01)

(52) U.S. Cl.
CPC ..... *G08B 21/0423* (2013.01); *G08B 21/0225* (2013.01); *G08B 21/043* (2013.01); *G08B 21/0415* (2013.01); *G08B 21/0438* (2013.01)

(58) Field of Classification Search
CPC ..... G08B 21/0423; G08B 21/0225; G08B 21/0438; G08B 21/043; G08B 21/0415
USPC ..... 340/573.1
See application file for complete search history.

(56) References Cited

U.S. PATENT DOCUMENTS 9,011,352 B2 4/2015 Ten Kate et al.
9,419,735 B2 8/2016 McCrea
2013/0218812 A1* 8/2013 Weiss ..... G06F 19/3418 706/10
2015/0365423 A1* 12/2015 Prokopi ..... G06F 21/316 713/152
2016/0307427 A1 10/2016 Haflinger et al.

FOREIGN PATENT DOCUMENTS

EP 2660745 A2 11/2013

OTHER PUBLICATIONS

Gay, et al., "A Health Monitoring System Using Smart Phones and Wearable Sensors", In International Journal of ARM, vol. 8, No. 2, Jun. 2007, pp. 29-36.
Habib, et al., "Smartphone-Based Solutions for Fall Detection and Prevention: Challenges and Open Issues", In Journal of Sensors, vol. 14, Issue 4, Apr. 22, 2014, pp. 7181-7208.
(Continued)

*Primary Examiner* — Tanmay Shah
(74) *Attorney, Agent, or Firm* — Schwegman Lundberg & Woessner, P.A.

(57) ABSTRACT

In example embodiments, a machine, including one or more processors and a memory, tracks, by communicating over a network with a plurality of devices associated with a user, activity of the user. The machine develops, using the one or more processors, an activity model for the user based on the tracked activity of the user. The machine determines, an anomaly in a current activity of the user relative to the developed activity model, the anomaly having a type and a duration. The machine calculates, based on the type and the duration of the anomaly, a confidence value corresponding to whether the user needs assistance and a severity value indicating severity of the user's need for assistance. The machine provides, to an emergency contact and via the network, an alert indicating that the user needs assistance based on the confidence value or the severity value.

17 Claims, 3 Drawing Sheets

(56) References Cited

OTHER PUBLICATIONS

Preece, Jeph, "The Best Fall Detection Sensors of 2017", http://www.toptenreviews.com/health/senior-care/best-fall-detection-sensors/, Published on: Jun. 9, 2016, 20 pages.
Concepcion, et al., "Mobile activity recognition and fall detection system for elderly people using Ameva algorithm", In Journal of Pervasive and Mobile Computing, vol. 34, Jan. 2017, 11 pages.
Igual, et al., "Challengers, issues and trends in fall detection systems", In Journal of BioMedical Engineering Online, Jul. 6, 2013, 13 pages.

* cited by examiner

EMERGENCY ALERTING SYSTEM AND METHOD

BACKGROUND

Many elderly people live alone (or live in care centers where a caregiver might not be watching them at all times). A person living alone or not being attended to by a caregiver might experience an emergency situation (e.g., a fall), which may be discovered by potential caregiver(s) several days after it takes place, potentially reducing the success rate of treatments or increasing the damage from the emergency situation. As the foregoing illustrates, a system and method for alerting an emergency contact when a person experiences an emergency situation may be desirable.

BRIEF DESCRIPTION OF THE DRAWINGS

Some embodiments of the technology are illustrated, by way of example and not limitation, in the figures of the accompanying drawings.

SUMMARY

Figure 1:
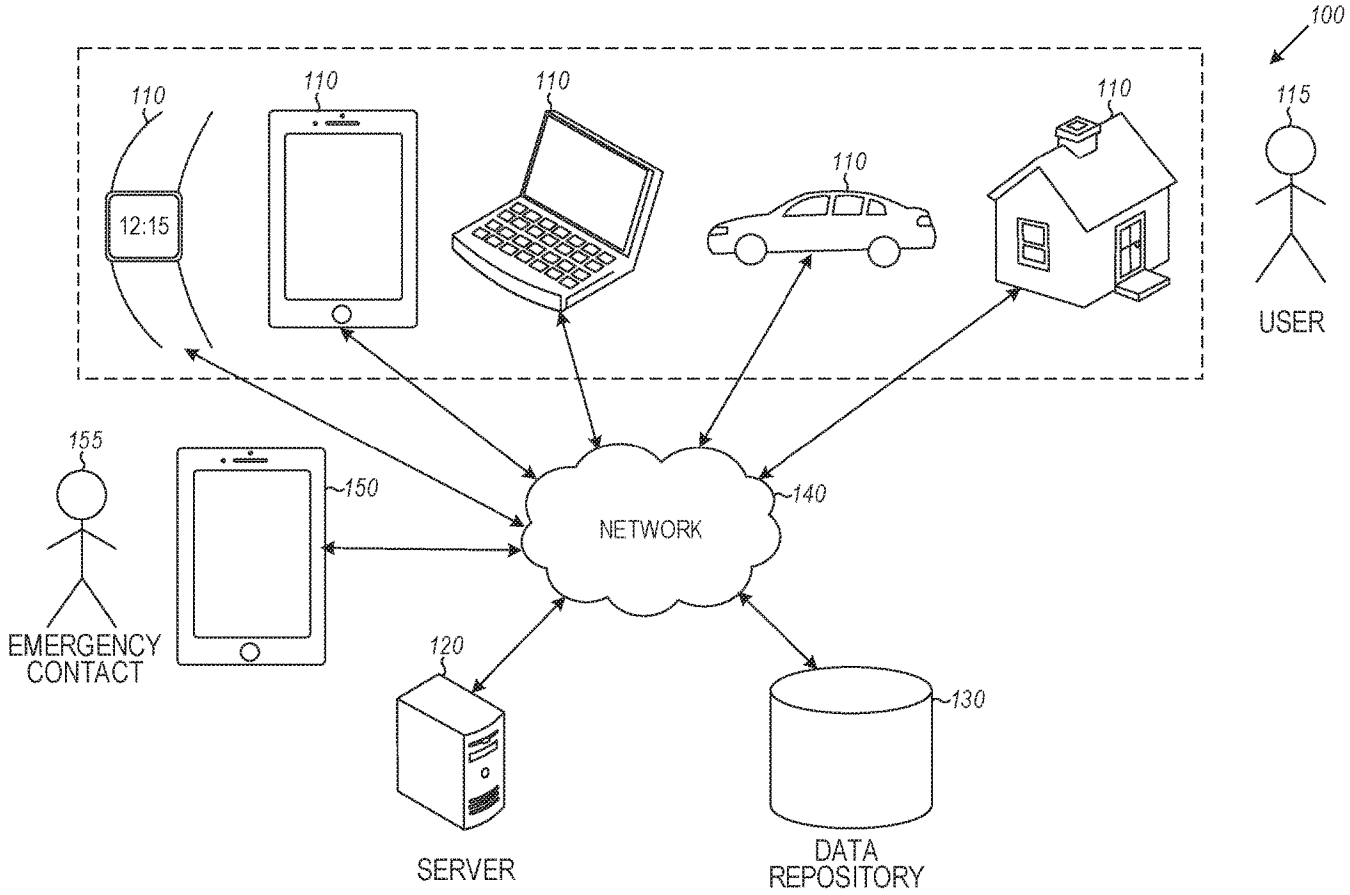
FIG. 1 illustrates an example system in which emergency alerting may be implemented, in accordance with some embodiments.

The present disclosure generally relates to machines configured for emergency alerting, including computerized variants of such special-purpose machines and improvements to such variants, and to the technologies by which such special-purpose machines become improved compared to other special-purpose machines that provide technology for emergency alerting. In particular, the present disclosure addresses systems and methods for emergency alerting.

According to some aspects, a machine includes one or more processors and a memory. The machine tracks, by communicating over a network with a plurality of devices associated with a user, activity of the user by combining signals from the plurality of devices. The machine develops, using the one or more processors, an activity model for the user based on the tracked activity of the user. The machine determines, based on combining the signals from the plurality of devices, an anomaly in a current activity of the user relative to the developed activity model, the anomaly having a type and a duration. The machine calculates, based on the type and the duration of the anomaly, a confidence value corresponding to whether the user needs assistance and a severity value indicating severity of the user's need for assistance. The machine provides, to an emergency contact and via the network, an alert indicating that the user needs assistance based on the confidence value or the severity value.

DETAILED DESCRIPTION

Overview

The present disclosure describes, among other things, methods, systems, and computer program products that individually provide various functionality. In the following description, for purposes of explanation, numerous specific details are set forth in order to provide a thorough understanding of the various aspects of different embodiments of the present disclosure. It will be evident, however, to one skilled in the art, that the present disclosure may be practiced without all of the specific details.

As noted above, a person living alone or not being attended to by a caregiver might experience an emergency situation (e.g., a fall or other accident), which may be discovered by potential caregiver(s) several days after it takes place, potentially reducing the success rate of treatments or increasing the damage from the emergency situation. As the foregoing illustrates, a system and method for alerting emergency contact(s) when a person experiences an emergency situation may be desirable.

In some aspects of the subject technology, a machine (e.g., a server or a client device of a user) includes one or more processors and a memory. The machine tracks, by communicating over a network with a plurality of devices associated with a user, activity of the user by combining signals from the plurality of devices. The plurality of devices may include one or more of a mobile phone, a tablet computer, a laptop computer, a desktop computer, a wearable device (e.g., a fitness tracker, a stability tracker, a heart rate monitor, and the like) a network-connected device (e.g., an Internet of Things (IoT) device) in a smart home, a vehicle, and the like. The activity of the user may include any activity in which the user interacts with one or more of the plurality of devices, such as checking email, accessing an application, opening a refrigerator, changing a temperature on a thermostat, driving a vehicle, taking a walk, and the like.

The machine develops, using the one or more processors, an activity model for the user based on the tracked activity of the user. The activity model includes a representation of everyday or repetitive activities of the user. For example, a user may typically walk one kilometer every evening and check his/her email once every 1-3 hours between 9 AM and 9 PM. The machine determines, based on combining the signals from the plurality of devices, an anomaly in a current activity of the user relative to the developed activity model, the anomaly having a type and a duration. For example, on a given day, the user may forego his/her evening walk and may not check his/her email at all after 12 noon. The type may include, for example, failing to walk, failing to check email, failing to use all electronic devices, failing to open a refrigerator, failing to operate a vehicle, accessing unusual content on an electronic device, and the like. Some aspects of the subject technology combine signals from multiple sources/devices. In some cases, rather than focusing on a single application (e.g., fall detection using a wearable device or noticing that a user stopped checking email), some aspects of the subject technology use machine learning techniques to combine multiple available signals from the user. The more signals are provided to the machine, the more accurate the model of the user's typical behavior (and the detection of anomalies) becomes.

The machine calculates, based on the type and the duration of the anomaly, a confidence value (e.g., a percentage) corresponding to whether the user needs assistance and a severity value indicating severity of the user's need for assistance. In some examples, the confidence value indicates how certain the machine is that the detected activity (or lack of activity) is indeed an emergency situation. The severity value corresponds to an estimate of how serious the emergency event is likely to be. The severity value may be based on a combination of information about the event itself (e.g., if a fall was detected by a wearable device in addition to a lack of activity from other devices typically used by the user). Information about the user (e.g., age, medical condition, distance from emergency assistance, and the like) may be taken into account. The confidence value may indicate how atypical the change in the user's activity is. The confidence value may take into account alternative explanations for the change in the user's activity (e.g., a power failure in the user's geographic location prevents tracking of the user or the user is traveling on vacation and, thus, is not checking email). The machine may provide, to an emergency contact and via the network, an alert indicating that the user needs assistance based on the confidence value or the severity value. For example, an alert may be provided if the confidence value, the severity value, or a mathematical combination of the confidence value and the severity value is within a predefined range (e.g., exceeds a threshold). In some cases, the confidence value and the severity value are used to decide if an action should be taken (e.g., primarily based on the confidence value) and what action should be taken (e.g., primarily based on the severity value). The action may include contacting an emergency contact identified by the user or the user's caregivers, contacting the police, or contacting a local ambulance service. The alert may be provided via email, push notification, short messaging service (SMS), or a push notification to a mobile device. As used herein, a range may include either (i) values exceeding a threshold (e.g., more than 10, or more than or equal to 10), (ii) values below a threshold (e.g., less than 5, or less than or equal to 5), or (iii) values exceeding a first threshold and below a second threshold (e.g., between 3 and 5).

The emergency contact may be identified automatically (e.g., a local police department or ambulance service) or may be identified by the user or those responsible for the user's care. For example, the user could specify, within an application (e.g., on a mobile phone, a tablet computer, a laptop computer, a desktop computer, or a website) for controlling the emergency alerting, one or more family members to be his/her emergency contacts. The emergency contacts may specify conditions under which they wish to receive notifications from the machine. For example, one emergency contact may wish to be contacted only when there is a high degree of certainty that the user needs assistance. Another emergency contact may wish to be contacted even if there is a lower degree of certainty that the user needs assistance and may also wish to receive daily SMS or email confirmations that the user is not having any anomalous activity. The emergency contact(s) may specify how he/she wishes to be notified and under which circumstances different types of communication (e.g., email, push notification, SMS notification, voice phone call, etc.) should be used.

The subject technology provides innovative solutions to problems including that falling when alone may be dangerous or even life threatening for an elderly person. The sooner a fall is detected and medical attention is provided, the greater the chance of a positive prognosis. Technologies that are capable of monitoring a user's activity via multiple different devices of a user may be useful in solving this problem.

Example Implementations

FIG. 1 illustrates an example system 100 in which emergency alerting may be implemented, in accordance with some embodiments. As shown, the system 100 includes a plurality of devices 110 of a user 115, a device 150 of an emergency contact 155 of the user 115, a server 120, and a data repository 130 connected to one another via a network 140. The network 140 may include one or more of the Internet, an intranet, a local area network, a wide area network, a wired network, a wireless network, a virtual private network (VPN), a cellular network, a Wi-Fi network, and the like.

The devices 110 of the user 115 may include any devices which may track activity of the user 115 and communicate over the network 140. As shown, the devices 110 include a fitness tracker, a mobile phone, a personal computer, a vehicle, and network-connected device(s) in a smart home. The network-connected device(s) may include a personal computer, a laptop, a home security camera (e.g., Nest Camera®), and the like. The devices 110 may also include other wearable devices, a smart watch, a smart television, a tablet computer, a laptop computer, a desktop computer, a personal digital assistant (PDA), an audio interface device, an e-book reader, and the like. The device 150 of the emergency contact 155 may be any device capable of receiving messages, such as a mobile phone, a landline telephone, or an email reading device. The data repository 130 stores data generated by the server 120, such as activity model(s) for user(s). The data repository 130 may be implemented as a database or any other data storage unit.

According to some aspects, the server 120 tracks, by communicating over the network 140 with the plurality of devices 110 associated with the user 115, activity of the user 115 by combining signals from the plurality of devices 110. The server 120 develops an activity model for the user 115 based on the tracked activity of the user 115. The server 120 stores the activity model in the data repository 130. In some cases, the activity model is stored, in the data repository 130, along with information about the user 115, such as the user's age, gender, geographic location, medical condition(s), taken medication(s), and the like. The server 120 determines, based on the developed activity model stored in the data repository 130 and based on combining activity data signals received from the plurality of devices 110, an anomaly in a current activity of the user 115 relative to the developed activity model. The anomaly has a type and a duration. The server 120 calculates, based on the type and the duration of the anomaly, a confidence value corresponding to whether the user 115 needs assistance and a severity value indicating severity of the user's need for assistance. The server 120 provides, to the device 150 of the emergency contact 155 and via the network 140, an alert indicating that the user 115 needs assistance based on the confidence value or the severity value. For example, the alert may be provided if the confidence value, the severity value, or a mathematical combination (e.g., sum, product, and the like) of the confidence value and the severity value is within a predefined range or exceeds a threshold. In accordance with some aspects of the subject technology, the server 120 combine signals from multiple devices 110 of the user 115 to develop the activity model and determine the anomaly in the current activity of the user 115. In some cases, rather than focusing on a single application (e.g., fall detection using a wearable device or noticing that a user stopped checking email), some aspects of the subject technology use machine learning techniques to combine, at the server 120, multiple available signals from the devices 110 of the user 115. The more signals are provided to the machine, the more accurate the model of the user's typical behavior (and the detection of anomalies) becomes. More details about example operations of the server 120 are provided in conjunction with FIG. 2.

Figure 2:
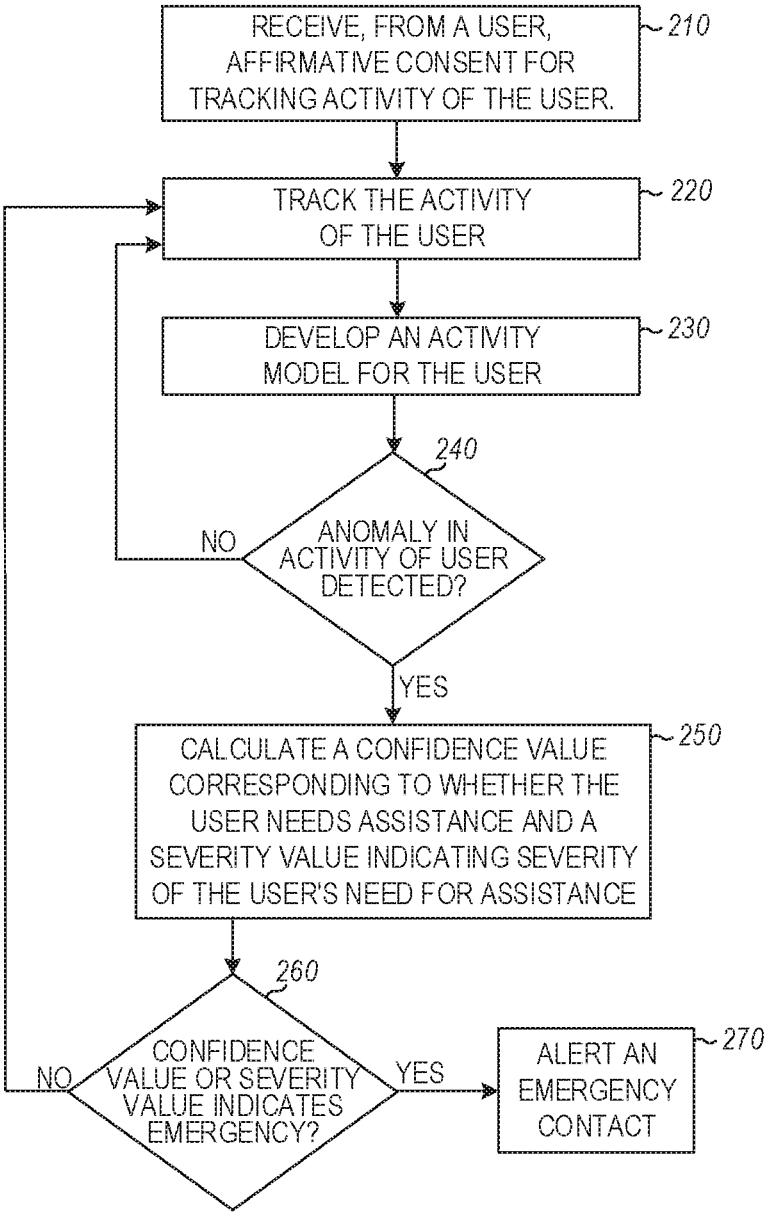
FIG. 2 is a flow chart illustrating an example method for emergency alerting, in accordance with some embodiments.

FIG. 2 is a flow chart illustrating an example method 200 for emergency alerting, in accordance with some embodiments. The method 200 is described herein as being implemented at the server 120. However, in alternative embodiments, the method 200 may be implemented locally at one of the devices 110 of the user 115. In other embodiments, the method 200 may be implemented in a system other than the system 100 and using machine(s) different from those of the system 100.

At operation 210, the server 120 receives, from the user 115 and via one of the devices 110 of the user 115, affirmative consent for tracking activity of the user. The affirmative consent may be provided, for example, by downloading an application for such tracking, registering to use the application, and approving an on-screen consent form. In some cases, the user 115 is provided with persistent notifications that his/her activity is being tracked. For example, the user 115 may receive periodic (e.g., weekly or monthly) emails that his/her activity is being tracked and, whenever the user 115 opens the application, the user 115 may be notified that the application is tracking the user's activity. The user 115 may remove his/her consent to tracking at any time. If the user 115 removes his/her consent for tracking his/her activity, all of the user's activity data is deleted from the server 120, the data repository 130, and any other network-based data stores that are not controlled directly by the user 115. If the user 115 fails to provide the affirmative consent or revokes the affirmative consent, the method 200 stops and the operations 220-270 are not performed. The tracking of the activity of the user 115 is in response to the affirmative consent received from the user. In some cases, the user 115 provides blanket affirmative consent to "tracking" all of the user's activity. Alternatively, the user 115 may provide more granular forms of consent. For example, the user may approve tracking of his/her use of email but not tracking his/her watching of online videos. In another example, the user may approve tracking of his/her use of the refrigerator but not the toaster. In some cases, the server 120 may communicate to the user 115 that the method 200 is most capable of detecting anomalies in the user's behavior and, therefore, emergencies, if it is able to track more of the user's behavior. In some cases, this may be communicated to the user when he/she excludes content from tracking. For example, the user may see a message saying "Excluding online videos makes it 2% less likely to detect an emergency event. Continue?" and then be asked to select a "Yes" button or a "No" button.

At operation 220, the server 120 tracks the activity of the user 115. The server 120 receives, via the network 140, data from the devices 110 about activity of the user 115 and combines the received data from the devices 110. The data may include, for example, how frequently and at what time(s) the user 115 accesses his/her computing devices, which application(s) he/she accesses, which network-connected (e.g., IoT) devices the user 115 accesses, when, and how frequently, time(s) when the user operates his/her vehicle and vehicle operation details, physical activity data of the user, geographic location data of the user, and the like. During setup of an application for implementing the method 200, the user causes all of his/her devices to be mapped to him/herself or his/her account. In some cases, one or more of the devices 110 may already be mapped to an account of the user with an online service provider (e.g., a Microsoft® account). In other cases, specialized software may be installed to track usage of the device 110 and communicate (with affirmative consent from the user 115) usage of the device 110 to the server 120. The user 115 may be associated with an identifier, and all of the user's devices and accounts may be mapped to the identifier.

At operation 230, the server 120 develops an activity model for the user 115 based on the tracked activity of the user (from operation 220). The activity model stores typical activities of the user 115 and confirms, based on tracking information received from the devices 110, that the user 115 is acting in accordance with his/her typical activities. The development of the activity model for the user may take approximately several days, and the activity model may be continuously refined after the initial period and may take into account changes in the user's activities over time. In some cases, during the development of the activity model, the server 102 still provides the functionality of the method 200 by using a population model in place of the activity model. The population model may correspond to normal activity for all users or a specifically-defined cohort of users. Cohorts may be based on age, gender, geographic location, medical conditions, medications taken, and the like. After it is developed, the activity model may be stored in a data structure that includes a list of data sources (e.g., devices 110 or application(s) on the devices 110) and, for each data source, a list of events observed in association with the data source. The activity model of the user 115 may be associated with an identifier or an account of the user 115.

At operation 240, the server 120 determines, based on combining the signals from the multiple devices 110, whether an anomaly in a current activity of the user 115, relative to the developed activity model, has been detected. The anomaly may have a type (e.g., failing to access computing devices) and a duration (e.g., three hours, five hours, etc.). If an anomaly in the current activity is detected, the method 200 continues to operation 250. If an anomaly in the current activity is not detected, the method 200 returns to operation 220 and continues tracking the activity of the user 115.

In some cases, prior to completing the development of the activity model in operation 230, the server 120 selects an estimated activity model for the user 115. The estimated activity model is based on data about the user 115, such as the user's age, gender, geographic location, medical condition(s), and taken medication(s). The estimated activity model may be a population model based on activity of multiple other users. For example, if the user 115 is a 74-year-old man living in Miami, Fla., the estimated activity model may be based on the activity models of other 70-80 year old men in the Miami metropolitan area who use the subject technology. The server 120 may determine, based on combining the signals from the multiple devices 110, a different anomaly in the current activity of the user relative to the estimated activity model. The different anomaly may be treated similarly to the original anomaly in implementing operations 250-270 below. However, the thresholds may be adjusted to make it less likely that an emergency contact would be reached, as false positives are more likely due to the lack of personalization. As a result, if the user 115 experiences an anomalous activity whole the activity model (of operation 230) is still being developed, the anomalous activity may be detected and the emergency contact may be notified.

At operation 250, upon detecting the anomaly, the server 120 calculates a confidence value corresponding to whether the user 115 needs assistance or attention and a severity value indicating severity of the user's need for assistance. The confidence value and the severity value are calculated based on the type and the duration of the anomaly. In some examples, the confidence value indicates how certain the machine is that the detected activity (or lack of activity) is indeed an emergency situation. The severity value corresponds to an estimate of how serious the emergency event is likely to be. The severity value may be based on a combination of information about the event itself (e.g., if a fall was detected by a wearable device in addition to a lack of activity from other devices typically used by the user). Information about the user (e.g., age, medical condition, distance from emergency assistance, and the like) may be taken into account. In some cases, the confidence value for the anomaly may take into account alternative explanations for the anomalous activity that does not correspond to needing attention or assistance. For example, the user may be foregoing using electronic devices and opening his/her refrigerator in observance of a religious fast. Alternatively, the user's daily habits (e.g., taking a walk in the evening) may change because the user is traveling. In some cases, a power outage or an outage of the network 140 (e.g., an Internet outage) may prevent uploading of activity tracking data from the devices 110 of the user 115 to the server 120. In other words, the server 120 determines one or more factors (e.g., Internet outage, travel, religious holiday, etc.) indicating that the anomaly does not correspond to the user 115 needing assistance. Upon identifying such one or more factors, the server 120 reduces the confidence value based on the one or more factors. The alternative explanations may be obtained from any sources connected to the network 140. For example, if the user specified his/her religion to the application managing the emergency alerts, the religious fast information may be obtained from a calendar of religious events. The user's travel information may be obtained from the user's email or calendar. Internet outage information may be obtained from cable, telephone, or power outages published online by local utility companies.

In some cases, the confidence value is calculated based on input, from the user 115, representing an anticipated type of anomaly. The user 115 may explicitly indicate an anticipated emergency event that he/she thinks is likely to occur. For example, if the user 115 indicates that he/she is an elderly person prone to falling and becoming immobile, lack of use of computing devices and devices within the home (e.g., refrigerator, stove, microwave, television, etc.) may indicate an emergency. Thus, the confidence value may increase quickly if the user 115 stops using all of his/her devices 110 without any other plausible explanation. Alternatively, if the user 115 indicates that he/she is a recovering drug addict, then accessing, at the devices 110, large amounts of content associated with using drugs (which the user 115 does not usually access) or visiting locations associated with using drugs (which the user 115 does not usually visit) may indicate a relapse and the confidence value may be more sensitive to such relapse-related activity changes. In another example, the user may explicitly indicate the presence of an emergency event (e.g., by dialing 9-1-1 or pressing an emergency button on a wearable device). This information would be provided to the server 120 and would be treated by the server 120 as a high-confidence signal that the user 115 needs assistance.

At operation 260, the server 120 determines whether the confidence value or the severity value indicate an emergency. In some cases, the confidence value or the severity value is seen to indicate an emergency if either the confidence value, the severity value, or a mathematical combination (e.g., sum, product, and the like) of the confidence value and the severity value is in a predefined range (e.g., exceeds a threshold). If so, at operation 270, the server 120 provides, to a device 150 of an emergency contact 155 of the user 115 an alert indicating that the user 115 needs assistance. In some cases, the alert is provided to a first emergency contact (e.g., a family member) if the confidence value, the severity value or the mathematical combination is within a first range and the alert is provided to a second emergency contact (e.g., a police department or ambulance service) if the confidence value, the severity value or the mathematical combination is within a second range. The second range corresponds to more confidence that an emergency or other assistance-requiring event has occurred and/or a more severe emergency. In some cases, a call tree may be used where a first emergency contact is contacted. If the first emergency contact does not confirm receipt of the communication and that he/she is able to attend to the user, a second emergency contact is contacted. If the second emergency contact does not confirm receipt of the communication and that he/she is able to attend to the user, a third emergency contact is contacted, et cetera. In some cases, a few minutes prior to providing the alert to the device 150 of the emergency contact 155, the user is provided an opportunity to indicate (e.g., by pressing a button on a computing device) that he/she is ok and does not need attention. In some examples, the alert may be coupled with information from a remote monitoring system of the user 115. For example, the remote monitoring device may provide a photograph of the user in his/her home taken by the remote monitoring device. The server 120 may provide, to the remote monitoring device, an instruction to take a photograph and transmit that photograph to the server 120 or the device 150 of the emergency contact 155. If the confidence value, the severity value, or the mathematical combination does not indicate the emergency, the method 200 returns to operation 220 and continues tracking the activity of the user 115.

In some aspects, the anomaly in the current activity of the user 115 is detected using any anomaly detection model. The model outputs a score depicting how likely an anomaly has been observed at each point in time. That score corresponds to the confidence value. The severity value is based on the nature of the signals that are missing and could be computed in different ways. For example, by giving each signal source a score based on how serious it is if we do not observe it (in some cases, tailored to the user 115 based on his/her habits) and then summing those scores at each point in time t based on [a] whether the signal is observed time t and [b] the timespan from t until when the signal was last observed. That score may be normalized to be between 0 and 1, and then thresholded to determine an appropriate action to take—ranging from "wait and see" to "contact emergency services now".

According to some aspects, the subject technology provides an intelligent cloud service that uses various signals from a user, including but not limited to: phone usage, wearables, app usage, and network-connected (e.g., IoT) devices. A personalized machine learning (ML) model may be built for each user. Anomalous or concerning/unusual behavior by the user triggers sending of a report to an emergency contact or care provider. Components of some aspects of the subject technology include: a personalized ML model of user behaviors across a broad array of signals; a cloud service running anomaly detection on aggregated data from disparate sources; leveraging a virtual assistant application (e.g., Microsoft Cortana® or Apple Siri®) interface to suppress false positives; and computing confidence values and severity values related to alert risk.

Some aspects of the subject technology relate to techniques for the automatic detection of inactivity in vulnerable individuals, and the communication of alerts to their designated caregivers. One use case targets the detection of emergency events such as falls or acute medical conditions.

Some aspects of the subject technology could help those at high risk of these events, such as elderly people living alone. Inactivity in these populations may signal acute health problems or other issues (e.g., falls) that could be life threatening and require immediate attention.

Some aspects of the subject technology are directed to a detection and alerting system whereby data from the devices 110 of the user 115 continuously stream into the server 120, and the server 120 continually monitors the data streams for evidence of inactivity. The server 120 monitors a combination of signals from a variety of devices 110 including: online activity, including search, browsing, transactions, social media engagement; physical detected from sensors such as wearable devices, smartphones, in-home cameras, and infrared sensors from a home alarm system; communications (e.g., calls placed or received, SMS sent or received, emails sent or received, explicitly checking email or voicemail, number of missed calls); computer activity, such as application usage and interaction data (mouse movements, keystrokes) and physical locations based on visited venues or global positioning system (GPS) coordinates.

These signals are linked with scheduling data and other inputs such as OOF (out of office) messages to improve the accuracy of the detection and reduce the number of false positives. If the user 115 is inactive but already has a valid reason for the inactivity logged in their calendar or OOF message, it is less likely that the user's inactivity is associated with the user 115 experiencing an actual emergency event.

Using the combination of these signals or a subset thereof, a ML model, residing at the server 120, generates a prediction of how likely the user 115 of the devices 110 needs assistance. One aspect of some implementations of the subject technology is the diversity of the signals (from multiple devices 110) being integrated. In other approaches, a single data source, from a single device 110, may be used. For example, fall detection may be provided by a wearable device.

The ML model could be trained on data collected during a dedicated training process where the user 115 is asked to record the streams above and simulate inactivity in different ways. In some aspects, the subject technology works with those already providing alerting services to collect data from real emergency events and link that data (with affirmative user consent) to other data streams. The server 120 implementing some aspects of the subject technology may continue to learn post deployment by asking users or caregivers how accurately it performed (e.g., providing an interface so that the user 115 or the emergency contact 155 may specify whether the user actually needed assistance or whether a false positive occurred).

The server 120, which implements the machine learning, learns over time what is normal for that user 115 based on the specific user's patterns of behavior (e.g., based on when the user 115 typically check email each day or how frequently the user 115 misses phone calls). This learning period may last from multiple days to multiple weeks. This may be completed before the personalized learnings are available to be applied by the server 120. The information collected during this period may be used to adapt the model or to tailor model thresholds for the specific user (or similar users, such as users having a common gender, age range, or geographic region). The non-personalized models, which may have a higher false positive rate, may be available from the outset.

A severity score may be generated as part of the prediction. The nature of the inactivity may be used in part to determine the severity score. For example, deviations from regular habits for the specific user 115 may carry greater evidential weight in the model than general features that apply to all users. A confidence score generated by the model reflects the likelihood of an error in the prediction, which is important in deciding whether to perform any type of alerting based on the predictions.

Scores can be compared to threshold(s) to decide whether to alert assigned caregivers or others or which caregiver(s) to alert. Alerts can also be provided to monitoring agencies, who can contact relevant authorities (e.g., police or medical services). If the severity score and the confidence score are both high, the server 120 may be capable of bypassing caregivers and monitoring agencies, and alerting relevant authorities directly.

In some examples, different degrees of severity or concern may be encoded in the score, (e.g., green/amber/red alert). This can be used to make determinations regarding the nature of the alert provided, including: who to contact (and how many people to contact simultaneously), how quickly to contact them (and what activities are interruptible to make contact with them, e.g., business meetings), the medium used to contact (e.g., email, SMS, phone call), and how long to wait for acknowledgement from one caregiver before contacting the next one.

Some aspects of the subject technology are described in conjunction with in-home scenarios. However, some aspects of the subject technology may be used for tracking inactivity in users as they travel away from home using all or a portion of the signals outlined above.

In summary, in various examples, the server 120 may detect worrisome or anomalous behavior by the user 115 based on a combination of mobile phone sensors (e.g., accelerometer and gyrometer), mobile phone usage (e.g., social media, email, messages, applications, sign-ins, missed calls, and adherence to a treatment or exercise plan in a treatment or exercise plan manager application), dedicated monitoring devise (button press life alerts and fall detectors), network-connected (e.g. IoT) device usage and output, wearable fitness device usage and output, personal computer (PC) usage, and WiFi network usage. The server 120 may take all or a subset of these inputs, to develop a personalized model for a user, and present reports to caregivers or emergency contacts at some frequency or when something anomalous occurs. This service could account for vacation or travel by using a virtual assistant application (e.g., Microsoft Cortana® or Apple Siri®). Alternatively, a user may provide an indication to the server 120 that he/she is away and that his/her habits may therefore be changed. In some cases, since the output of provided by the server 120 may include generating a report (rather than calling the police), false positives are not so worrisome. However, if there is a high confidence that an anomalous event has occurred, the police may be notified.

In some implementations, a confidence system is built on how confident the server 120 is that there is a problem, as well as a severity value, which corresponds to a point system to represent the magnitude of the problem itself. Safeguards may be in place to escalate if the emergency contacts/caregivers do not read the report. The predictive models of some aspects of the subject technology may be expanded past elderly care to help suicide prevention, drug relapse, and the like.

Numbered Examples

Certain embodiments are described herein as numbered examples 1, 2, 3, etc. These numbered examples are provided as examples only and do not limit the subject technology.

Example 1 is a system comprising: one or more processors; and a memory comprising instructions which, when executed by the one or more processors, cause the one or more processors to perform operations comprising: tracking, by communicating over a network with a plurality of devices associated with a user, activity of the user; developing, using the one or more processors, an activity model for the user based on the tracked activity of the user; determining an anomaly in a current activity of the user relative to the developed activity model, the anomaly having a type and a duration; calculating, based on the type and the duration of the anomaly, a confidence value corresponding to whether the user needs assistance; and providing, to an emergency contact and via the network, an alert indicating that the user needs assistance if the confidence value is within a predefined range.

Example 2 is the system of Example 1, the operations further comprising: receiving, from the user, affirmative consent for tracking the activity of the user, wherein tracking the activity of user is in response to the affirmative consent received from the user.

Example 3 is the system of Example 1, the operations further comprising: selecting an estimated activity model for the user prior to developing the activity model, the estimated activity model being based on an age, a gender, and a geographic location of the user; determining a different anomaly in a current activity of the user relative to the estimated activity model, the different anomaly having a type and a duration; calculating, based on the type and the duration of the second anomaly, a second confidence value corresponding to whether the user needs assistance; and providing, to the emergency contact and via the network, a second alert indicating that the user needs assistance if the confidence value is within the predefined range.

Example 4 is the system of Example 1, the operations further comprising: determining one or more factors indicating that the anomaly does not correspond to the user needing assistance; and reducing the confidence value based on the one or more factors.

Example 5 is the system of Example 1, wherein the plurality of devices comprise two or more of a mobile phone, a fitness tracker, a vehicle, and a network-connected device in a smart home.

Example 6 is the system of Example 1, wherein the alert comprises information from a remote monitoring device of the user.

Example 7 is the system of Example 1, wherein providing the alert to the emergency contact comprises: providing the alert to a first emergency contact if the confidence value is within a first range; and providing the alert to a second emergency contact if the confidence value is within a second range.

Example 8 is the system of Example 1, wherein the confidence value is calculated based on an input, from the user, representing an anticipated type of anomaly.

Example 9 is a machine-readable medium comprising instructions which, when executed by one or more processors of a machine, cause the one or more processors to perform operations comprising: tracking, by communicating over a network with a plurality of devices associated with a user, activity of the user; developing, using the one or more processors, an activity model for the user based on the tracked activity of the user; determining an anomaly in a current activity of the user relative to the developed activity model, the anomaly having a type and a duration; calculating, based on the type and the duration of the anomaly, a confidence value corresponding to whether the user needs assistance; and providing, to an emergency contact and via the network, an alert indicating that the user needs assistance if the confidence value is within a predefined range.

Example 10 is the machine-readable medium of Example 9, the operations further comprising: receiving, from the user, affirmative consent for tracking the activity of the user, wherein tracking the activity of user is in response to the affirmative consent received from the user.

Example 11 is the machine-readable medium of Example 9, the operations further comprising: selecting an estimated activity model for the user prior to developing the activity model, the estimated activity model being based on an age, a gender, and a geographic location of the user; and determining a different anomaly in a current activity of the user relative to the estimated activity model, the different anomaly having a type and a duration; calculating, based on the type and the duration of the second anomaly, a second confidence value corresponding to whether the user needs assistance; and providing, to the emergency contact and via the network, a second alert indicating that the user needs assistance if the confidence value is within the predefined range.

Example 12 is the machine-readable medium of Example 9, the operations further comprising: determining one or more factors indicating that the anomaly does not correspond to the user needing assistance; and reducing the confidence value based on the one or more factors.

Example 13 is the machine-readable medium of Example 9, wherein the plurality of devices comprise two or more of a mobile phone, a fitness tracker, a vehicle, and a network-connected device in a smart home.

Example 14 is the machine-readable medium of Example 9, wherein the alert comprises information from a remote monitoring device of the user.

Example 15 is the machine-readable medium of Example 9, wherein providing the alert to the emergency contact comprises: providing the alert to a first emergency contact if the confidence value is within a first range; and providing the alert to a second emergency contact if the confidence value is within a second range.

Example 16 is the machine-readable medium of Example 9, wherein the confidence value is calculated based on an input, from the user, representing an anticipated type of anomaly.

Example 17 is a method implemented at one or more processors of a machine, the method comprising: tracking, by communicating over a network with a plurality of devices associated with a user, activity of the user; developing, using the one or more processors, an activity model for the user based on the tracked activity of the user; determining an anomaly in a current activity of the user relative to the developed activity model, the anomaly having a type and a duration; calculating, based on the type and the duration of the anomaly, a confidence value corresponding to whether the user needs assistance; and providing, to an emergency contact and via the network, an alert indicating that the user needs assistance if the confidence value is within a predefined range.

Example 18 is the method of Example 17, the operations further comprising: receiving, from the user, affirmative consent for tracking the activity of the user, wherein tracking the activity of user is in response to the affirmative consent received from the user.

Example 19 is the method of Example 17, further comprising: selecting an estimated activity model for the user prior to developing the activity model, the estimated activity model being based on an age, a gender, and a geographic location of the user; and determining a different anomaly in a current activity of the user relative to the estimated activity model, the different anomaly having a type and a duration; calculating, based on the type and the duration of the second anomaly, a second confidence value corresponding to whether the user needs assistance; and providing, to the emergency contact and via the network, a second alert indicating that the user needs assistance if the confidence value is within the predefined range.

Example 20 is the method of Example 17, further comprising: determining one or more factors indicating that the anomaly does not correspond to the user needing assistance; and reducing the confidence value based on the one or more factors.

Example 21 is the method of Example 17, wherein the plurality of devices comprise two or more of a mobile phone, a fitness tracker, a vehicle, and an Internet of Things (IoT) device in a smart home.

Example 22 is the method of Example 17, wherein the alert comprises information from a remote monitoring device of the user.

Example 23 is the method of Example 17, wherein providing the alert to the emergency contact comprises: providing the alert to a first emergency contact if the confidence value is within a first range; and providing the alert to a second emergency contact if the confidence value is within a second range.

Example 24 is the method of Example 17, wherein the confidence value is calculated based on an input, from the user, representing an anticipated type of anomaly.

Components and Logic

Certain embodiments are described herein as including logic or a number of components or mechanisms. Components may constitute either software components (e.g., code embodied on a machine-readable medium) or hardware components. A "hardware component" is a tangible unit capable of performing certain operations and may be configured or arranged in a certain physical manner. In various example embodiments, one or more computer systems (e.g., a standalone computer system, a client computer system, or a server computer system) or one or more hardware components of a computer system (e.g., a processor or a group of processors) may be configured by software (e.g., an application or application portion) as a hardware component that operates to perform certain operations as described herein.

In some embodiments, a hardware component may be implemented mechanically, electronically, or any suitable combination thereof. For example, a hardware component may include dedicated circuitry or logic that is permanently configured to perform certain operations. For example, a hardware component may be a special-purpose processor, such as a Field-Programmable Gate Array (FPGA) or an Application Specific Integrated Circuit (ASIC). A hardware component may also include programmable logic or circuitry that is temporarily configured by software to perform certain operations. For example, a hardware component may include software executed by a general-purpose processor or other programmable processor. Once configured by such software, hardware components become specific machines (or specific components of a machine) uniquely tailored to perform the configured functions and are no longer general-purpose processors. It will be appreciated that the decision to implement a hardware component mechanically, in dedicated and permanently configured circuitry, or in temporarily configured circuitry (e.g., configured by software) may be driven by cost and time considerations.

Accordingly, the phrase "hardware component" should be understood to encompass a tangible record, be that an record that is physically constructed, permanently configured (e.g., hardwired), or temporarily configured (e.g., programmed) to operate in a certain manner or to perform certain operations described herein. As used herein, "hardware-implemented component" refers to a hardware component. Considering embodiments in which hardware components are temporarily configured (e.g., programmed), each of the hardware components need not be configured or instantiated at any one instance in time. For example, where a hardware component comprises a general-purpose processor configured by software to become a special-purpose processor, the general-purpose processor may be configured as respectively different special-purpose processors (e.g., comprising different hardware components) at different times. Software accordingly configures a particular processor or processors, for example, to constitute a particular hardware component at one instance of time and to constitute a different hardware component at a different instance of time.

Hardware components can provide information to, and receive information from, other hardware components. Accordingly, the described hardware components may be regarded as being communicatively coupled. Where multiple hardware components exist contemporaneously, communications may be achieved through signal transmission (e.g., over appropriate circuits and buses) between or among two or more of the hardware components. In embodiments in which multiple hardware components are configured or instantiated at different times, communications between such hardware components may be achieved, for example, through the storage and retrieval of information in memory structures to which the multiple hardware components have access. For example, one hardware component may perform an operation and store the output of that operation in a memory device to which it is communicatively coupled. A further hardware component may then, at a later time, access the memory device to retrieve and process the stored output. Hardware components may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented components that operate to perform one or more operations or functions described herein. As used herein, "processor-implemented component" refers to a hardware component implemented using one or more processors.

Similarly, the methods described herein may be at least partially processor-implemented, with a particular processor or processors being an example of hardware. For example, at least some of the operations of a method may be performed by one or more processors or processor-implemented components. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an API).

The performance of certain of the operations may be distributed among the processors, not only residing within a single machine, but deployed across a number of machines.

In some example embodiments, the processors or processor-implemented components may be located in a single geographic location (e.g., within a home environment, an office environment, or a server farm). In other example embodiments, the processors or processor-implemented components may be distributed across a number of geographic locations.

Some aspects of the subject technology involve collecting personal information about users. It should be noted that the personal information about a user is collected after receiving affirmative consent from the users for the collection and storage of such information. Persistent reminders (e.g., email messages or information displays within an application) are provided to the user to notify the user that his/her information is being collected and stored. The persistent reminders may be provided whenever the user accesses an application or once every threshold time period (e.g., an email message every week). For instance, an arrow symbol may be displayed to the user on his/her mobile device to notify the user that his/her global positioning system (GPS) location is being tracked. Personal information is stored in a secure manner to ensure that no unauthorized access to the information takes place. For example, medical and health related information may be stored in a Health Insurance Portability and Accountability Act (HIPAA) compliant manner.

Example Machine and Software Architecture

The components, methods, applications, and so forth described in conjunction with FIGS. 1-2 are implemented in some embodiments in the context of a machine and an associated software architecture. The sections below describe representative software architecture(s) and machine (e.g., hardware) architecture(s) that are suitable for use with the disclosed embodiments.

Software architectures are used in conjunction with hardware architectures to create devices and machines tailored to particular purposes. For example, a particular hardware architecture coupled with a particular software architecture will create a mobile device, such as a mobile phone, tablet device, or so forth. A slightly different hardware and software architecture may yield a smart device for use in the "internet of things," while yet another combination produces a server computer for use within a cloud computing architecture. Not all combinations of such software and hardware architectures are presented here, as those of skill in the art can readily understand how to implement the disclosed subject matter in different contexts from the disclosure contained herein.

Figure 3:
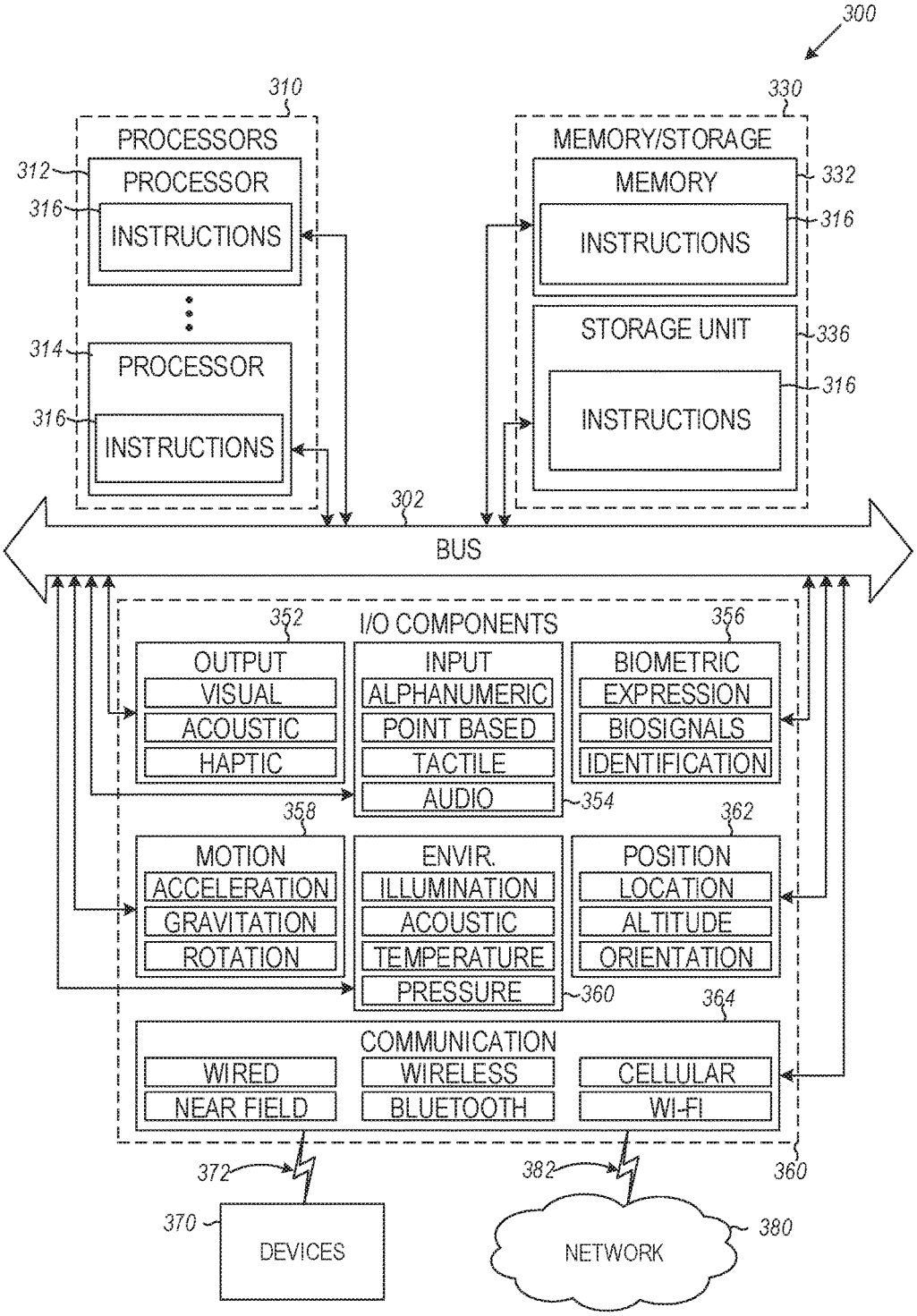
FIG. 3 is a block diagram illustrating components of a machine able to read instructions from a machine-readable medium and perform any of the methodologies discussed herein, in accordance with some embodiments.

FIG. 3 is a block diagram illustrating components of a machine 300, according to some example embodiments, able to read instructions from a machine-readable medium (e.g., a machine-readable storage medium) and perform any one or more of the methodologies discussed herein. Specifically, FIG. 3 shows a diagrammatic representation of the machine 300 in the example form of a computer system, within which instructions 316 (e.g., software, a program, an application, an applet, an app, or other executable code) for causing the machine 300 to perform any one or more of the methodologies discussed herein may be executed. The instructions 316 transform the general, non-programmed machine into a particular machine programmed to carry out the described and illustrated functions in the manner described. In alternative embodiments, the machine 300 operates as a standalone device or may be coupled (e.g., networked) to other machines. In a networked deployment, the machine 300 may operate in the capacity of a server machine or a client machine in a server-client network environment, or as a peer machine in a peer-to-peer (or distributed) network environment. The machine 300 may comprise, but not be limited to, a server computer, a client computer, PC, a tablet computer, a laptop computer, a netbook, a personal digital assistant (PDA), an entertainment media system, a cellular telephone, a smart phone, a mobile device, a wearable device (e.g., a smart watch), a smart home device (e.g., a smart appliance), other smart devices, a web appliance, a network router, a network switch, a network bridge, or any machine capable of executing the instructions 316, sequentially or otherwise, that specify actions to be taken by the machine 300. Further, while only a single machine 300 is illustrated, the term "machine" shall also be taken to include a collection of machines 300 that individually or jointly execute the instructions 316 to perform any one or more of the methodologies discussed herein.

The machine 300 may include processors 310, memory/storage 330, and I/O components 350, which may be configured to communicate with each other such as via a bus 302. In an example embodiment, the processors 310 (e.g., a Central Processing Unit (CPU), a Reduced Instruction Set Computing (RISC) processor, a Complex Instruction Set Computing (CISC) processor, a Graphics Processing Unit (GPU), a Digital Signal Processor (DSP), an ASIC, a Radio-Frequency Integrated Circuit (RFIC), another processor, or any suitable combination thereof) may include, for example, a processor 312 and a processor 314 that may execute the instructions 316. The term "processor" is intended to include multi-core processors that may comprise two or more independent processors (sometimes referred to as "cores") that may execute instructions contemporaneously. Although FIG. 3 shows multiple processors 310, the machine 300 may include a single processor with a single core, a single processor with multiple cores (e.g., a multi-core processor), multiple processors with a single core, multiple processors with multiples cores, or any combination thereof.

The memory/storage 330 may include a memory 332, such as a main memory, or other memory storage, and a storage unit 336, both accessible to the processors 310 such as via the bus 302. The storage unit 336 and memory 332 store the instructions 316 embodying any one or more of the methodologies or functions described herein. The instructions 316 may also reside, completely or partially, within the memory 332, within the storage unit 336, within at least one of the processors 310 (e.g., within the processor's cache memory), or any suitable combination thereof, during execution thereof by the machine 300. Accordingly, the memory 332, the storage unit 336, and the memory of the processors 310 are examples of machine-readable media.

As used herein, "machine-readable medium" means a device able to store instructions (e.g., instructions 316) and data temporarily or permanently and may include, but is not limited to, random-access memory (RAM), read-only memory (ROM), buffer memory, flash memory, optical media, magnetic media, cache memory, other types of storage (e.g., Erasable Programmable Read-Only Memory (EEPROM)), and/or any suitable combination thereof. The term "machine-readable medium" should be taken to include a single medium or multiple media (e.g., a centralized or distributed database, or associated caches and servers) able to store the instructions 316. The term "machine-readable medium" shall also be taken to include any medium, or combination of multiple media, that is capable of storing instructions (e.g., instructions 316) for execution by a machine (e.g., machine 300), such that the instructions, when executed by one or more processors of the machine (e.g., processors 310), cause the machine to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" excludes signals per se.

The I/O components 350 may include a wide variety of components to receive input, provide output, produce output, transmit information, exchange information, capture measurements, and so on. The specific I/O components 350 that are included in a particular machine will depend on the type of machine. For example, portable machines such as mobile phones will likely include a touch input device or other such input mechanisms, while a headless server machine will likely not include such a touch input device. It will be appreciated that the I/O components 350 may include many other components that are not shown in FIG. 3. The I/O components 350 are grouped according to functionality merely for simplifying the following discussion and the grouping is in no way limiting. In various example embodiments, the I/O components 350 may include output components 352 and input components 354. The output components 352 may include visual components (e.g., a display such as a plasma display panel (PDP), a light emitting diode (LED) display, a liquid crystal display (LCD), a projector, or a cathode ray tube (CRT)), acoustic components (e.g., speakers), haptic components (e.g., a vibratory motor, resistance mechanisms), other signal generators, and so forth. The input components 354 may include alphanumeric input components (e.g., a keyboard, a touch screen configured to receive alphanumeric input, a photo-optical keyboard, or other alphanumeric input components), point based input components (e.g., a mouse, a touchpad, a trackball, a joystick, a motion sensor, or another pointing instrument), tactile input components (e.g., a physical button, a touch screen that provides location and/or force of touches or touch gestures, or other tactile input components), audio input components (e.g., a microphone), and the like.

In further example embodiments, the I/O components 350 may include biometric components 356, motion components 358, environmental components 360, or position components 362, among a wide array of other components. For example, the biometric components 356 may include components to detect expressions (e.g., hand expressions, facial expressions, vocal expressions, body gestures, or eye tracking), measure biosignals (e.g., blood pressure, heart rate, body temperature, perspiration, or brain waves), measure exercise-related metrics (e.g., distance moved, speed of movement, or time spent exercising) identify a person (e.g., voice identification, retinal identification, facial identification, fingerprint identification, or electroencephalogram based identification), and the like. The motion components 358 may include acceleration sensor components (e.g., accelerometer), gravitation sensor components, rotation sensor components (e.g., gyroscope), and so forth. The environmental components 360 may include, for example, illumination sensor components (e.g., photometer), temperature sensor components (e.g., one or more thermometers that detect ambient temperature), humidity sensor components, pressure sensor components (e.g., barometer), acoustic sensor components (e.g., one or more microphones that detect background noise), proximity sensor components (e.g., infrared sensors that detect nearby objects), gas sensors (e.g., gas detection sensors to detect concentrations of hazardous gases for safety or to measure pollutants in the atmosphere), or other components that may provide indications, measurements, or signals corresponding to a surrounding physical environment. The position components 362 may include location sensor components (e.g., a Global Position System (GPS) receiver component), altitude sensor components (e.g., altimeters or barometers that detect air pressure from which altitude may be derived), orientation sensor components (e.g., magnetometers), and the like.

Communication may be implemented using a wide variety of technologies. The I/O components 350 may include communication components 364 operable to couple the machine 300 to a network 380 or devices 370 via a coupling 382 and a coupling 372, respectively. For example, the communication components 364 may include a network interface component or other suitable device to interface with the network 380. In further examples, the communication components 364 may include wired communication components, wireless communication components, cellular communication components, Near Field Communication (NFC) components, Bluetooth® components (e.g., Bluetooth® Low Energy), Wi-Fi® components, and other communication components to provide communication via other modalities. The devices 370 may be another machine or any of a wide variety of peripheral devices (e.g., a peripheral device coupled via a USB).

Moreover, the communication components 364 may detect identifiers or include components operable to detect identifiers. For example, the communication components 364 may include Radio Frequency Identification (RFID) tag reader components, NFC smart tag detection components, optical reader components, or acoustic detection components (e.g., microphones to identify tagged audio signals). In addition, a variety of information may be derived via the communication components 364, such as location via Internet Protocol (IP) geolocation, location via Wi-Fi® signal triangulation, location via detecting an NFC beacon signal that may indicate a particular location, and so forth.

In various example embodiments, one or more portions of the network 380 may be an ad hoc network, an intranet, an extranet, a virtual private network (VPN), a local area network (LAN), a wireless LAN (WLAN), a WAN, a wireless WAN (WWAN), a metropolitan area network (MAN), the Internet, a portion of the Internet, a portion of the Public Switched Telephone Network (PSTN), a plain old telephone service (POTS) network, a cellular telephone network, a wireless network, a Wi-Fi® network, another type of network, or a combination of two or more such networks. For example, the network 380 or a portion of the network 380 may include a wireless or cellular network and the coupling 382 may be a Code Division Multiple Access (CDMA) connection, a Global System for Mobile communications (GSM) connection, or another type of cellular or wireless coupling. In this example, the coupling 382 may implement any of a variety of types of data transfer technology, such as Single Carrier Radio Transmission Technology (1×RTT), Evolution-Data Optimized (EVDO) technology, General Packet Radio Service (GPRS) technology, Enhanced Data rates for GSM Evolution (EDGE) technology, third Generation Partnership Project (3GPP) including 3G, fourth generation wireless (4G) networks, Universal Mobile Telecommunications System (UMTS), High Speed Packet Access (HSPA), Worldwide Interoperability for Microwave Access (WiMAX), Long Term Evolution (LTE) standard, others defined by various standard-setting organizations, other long range protocols, or other data transfer technology.

The instructions 316 may be transmitted or received over the network 380 using a transmission medium via a network interface device (e.g., a network interface component included in the communication components 364) and utilizing any one of a number of well-known transfer protocols (e.g., HTTP). Similarly, the instructions 316 may be transmitted or received using a transmission medium via the coupling 372 (e.g., a peer-to-peer coupling) to the devices 370. The term "transmission medium" shall be taken to include any intangible medium that is capable of storing, encoding, or carrying the instructions 316 for execution by the machine 300, and includes digital or analog communications signals or other intangible media to facilitate communication of such software.

What is claimed is:

1. A system comprising:

one or more processors; and a memory comprising instructions which, when executed by the one or more processors, cause the one or more processors to perform operations comprising:

tracking, by communicating over a network with a plurality of devices associated with a user, activity of the user by combining signals from the plurality of devices;

developing, using the one or more processors, an activity model for the user based on the tracked activity of the user;

determining, based on combining the signals from the plurality of devices, an anomaly in a current activity of the user relative to the developed activity model, the anomaly having a type and a duration;

calculating, based on the type and the duration of the anomaly, a confidence value corresponding to whether the user needs assistance and a severity value indicating severity of the user's need for assistance;

determining one or more factors indicating that the anomaly does not correspond to the user needing assistance;

reducing the confidence value or the severity value based on the one or more factors; and providing, to an emergency contact and via the network, an alert indicating that the user needs assistance based on the confidence value or the severity value, wherein providing the alert to the emergency contact comprises:

providing the alert to a first emergency contact if the confidence value is within a first range; and providing the alert to a second emergency contact if the confidence value is within a second range.

2. The system of claim 1, the operations further comprising:

receiving, from the user, affirmative consent for tracking the activity of the user, wherein tracking the activity of user is in response to the affirmative consent received from the user.

3. The system of claim 1, the operations further comprising:

selecting an estimated activity model for the user prior to developing the activity model, the estimated activity model being based on an age, a gender, a geographic location, a medical condition, and a taken medication of the user;

determining, based on combining the signals from the plurality of devices, a different anomaly in a current activity of the user relative to the estimated activity model, the different anomaly having a type and a duration;

calculating, based on the type and the duration of the second anomaly, a second confidence value corresponding to whether the user needs assistance and a severity value indicating severity of the user's need for assistance; and providing, to the emergency contact and via the network, a second alert indicating that the user needs assistance if the confidence value is within the predefined range.

4. The system of claim 3, wherein the estimated activity model comprises a population model based on activity of a plurality of users.

5. The system of claim 1, wherein the plurality of devices are selected from a group comprising: a mobile phone, a smart watch, a fitness tracker, a vehicle, and a network-connected device in a smart home.

6. The system of claim 1, wherein the alert comprises information from a remote monitoring device of the user.

7. The system of claim 1, wherein the confidence value is calculated based on an input, from the user, representing an anticipated type of anomaly.

8. A non-transitory machine-readable medium comprising instructions which, when executed by one or more processors of a machine, cause the one or more processors to perform operations comprising:

tracking, by communicating over a network with a plurality of devices associated with a user, activity of the user by combining signals from the plurality of devices;

developing, using the one or more processors, an activity model for the user based on the tracked activity of the user;

determining, based on combining the signals from the plurality of devices, an anomaly in a current activity of the user relative to the developed activity model, the anomaly having a type and a duration;

calculating, based on the type and the duration of the anomaly, a confidence value corresponding to whether the user needs assistance and a severity value indicating severity of the user's need for assistance;

determining one or more factors indicating that the anomaly does not correspond to the user needing assistance;

reducing the confidence value or the severity value based on the one or more factors;

providing, to an emergency contact and via the network, an alert indicating that the user needs assistance based on the confidence value or the severity value;

selecting an estimated activity model for the user prior to developing the activity model, the estimated activity model being based on an age, a gender, a geographic location, a medical condition, and a taken medication of the user;

determining, based on combining the signals from the plurality of devices, a different anomaly in a current activity of the user relative to the estimated activity model, the different anomaly having a type and a duration;

calculating, based on the type and the duration of the second anomaly, a second confidence value corresponding to whether the user needs assistance and a severity value indicating severity of the user's need for assistance; and providing, to the emergency contact and via the network, a second alert indicating that the user needs assistance if the confidence value is within the predefined range.

9. The machine-readable medium of claim 8, the operations further comprising:

receiving, from the user, affirmative consent for tracking the activity of the user, wherein tracking the activity of user is in response to the affirmative consent received from the user.

10. The machine-readable medium of claim 8, wherein the plurality of devices are selected from a group comprising: a mobile phone, a smart watch, a fitness tracker, a vehicle, and a network-connected device in a smart home.

11. The machine-readable medium of claim 8, wherein the alert comprises information from a remote monitoring device of the user.

12. The machine-readable medium of claim 8, wherein providing the alert to the emergency contact comprises:

providing the alert to a first emergency contact if the confidence value is within a first range; and providing the alert to a second emergency contact if the confidence value is within a first range.

13. A method implemented at one or more processors of a machine, the method comprising:

tracking, by communicating over a network with a plurality of devices associated with a user, activity of the user by combining signals from the plurality of devices;

developing, using the one or more processors, an activity model for the user based on the tracked activity of the user;

determining, based on combining the signals from the plurality of devices, an anomaly in a current activity of the user relative to the developed activity model, the anomaly having a type and a duration;

calculating, based on the type and the duration of the anomaly, a confidence value corresponding to whether the user needs assistance and a severity value indicating severity of the user's need for assistance;

determining one or more factors indicating that the anomaly does not correspond to the user needing assistance;

reducing the confidence value or the severity value based on the one or more factors; and providing, to an emergency contact and via the network, an alert indicating that the user needs assistance based on the confidence value or the severity value, wherein providing the alert to the emergency contact comprises:

providing the alert to a first emergency contact if the confidence value is within a first range; and providing the alert to a second emergency contact if the confidence value is within a second range.

14. The method of claim 13, further comprising:

receiving, from the user, affirmative consent for tracking the activity of the user, wherein tracking the activity of user is in response to the affirmative consent received from the user.

15. The method of claim 13, further comprising:

selecting an estimated activity model for the user prior to developing the activity model, the estimated activity model being based on an age, a gender, a geographic location, a medical condition, and a taken medication of the user;

determining, based on combining the signals from the plurality of devices, a different anomaly in a current activity of the user relative to the estimated activity model; the different anomaly having a type and a duration;

calculating, based on the type and the duration of the second anomaly, a second confidence value corresponding to whether the user needs assistance and a severity value indicating severity of the user's need for assistance; and providing, to the emergency contact and via the network, a second alert indicating that the user needs assistance if the confidence value is within the predefined range.

16. The method of claim 13, wherein the plurality of devices are selected from a group comprising: a mobile phone, a smart watch, a fitness tracker, a vehicle, and a network-connected device in a smart home.

17. The method of claim 13, wherein the alert comprises information from a remote monitoring device of the user.

* * * * *